US006475074B2

(12) United States Patent
Blanton

(10) Patent No.: US 6,475,074 B2
(45) Date of Patent: Nov. 5, 2002

(54) SHARPENER ATTACHMENT FOR ROTARY TOOL

(76) Inventor: Dean Blanton, 495 Eagle Point, Roaming Shores, OH (US) 44084

( * ) Notice: Subject to any disclaimer, the term of this patent is extended or adjusted under 35 U.S.C. 154(b) by 12 days.

(21) Appl. No.: 09/753,029

(22) Filed: Jan. 2, 2001

(65) Prior Publication Data

US 2002/0058467 A1 May 16, 2002

Related U.S. Application Data

(63) Continuation-in-part of application No. 09/713,715, filed on Nov. 15, 2000, now abandoned.

(51) Int. Cl.[7] ..... B24B 3/00

(52) U.S. Cl. ..... 451/224; 451/377; 451/213; 144/135.2; 144/134.1

(58) Field of Search ..... 451/419–423, 451/421, 422, 367, 371, 372, 206, 202, 203, 224, 229, 234, 213, 212, 377; 30/329; 76/37; 144/135.2, 134.1

(56) References Cited

U.S. PATENT DOCUMENTS 3,054,229 A * 9/1962 Peasley et al. ..... 451/224
3,733,751 A * 5/1973 Williams ..... 451/367
3,881,888 A * 5/1975 Schwab ..... 451/420
3,885,352 A * 5/1975 Juranitch ..... 451/367
4,155,383 A * 5/1979 Welliver ..... 144/134.1
4,262,558 A * 4/1981 Long ..... 76/37
4,512,111 A * 4/1985 Childers ..... 451/367
4,538,654 A 9/1985 Nickoloff
4,653,232 A 3/1987 Foreman
4,936,053 A * 6/1990 Shanelec ..... 451/224
4,961,288 A * 10/1990 Ketteringham ..... 451/224
5,191,737 A * 3/1993 Snoddy ..... 451/367
5,218,787 A * 6/1993 Rice ..... 451/367
5,241,791 A * 9/1993 Lacy ..... 451/224
5,301,473 A * 4/1994 Seear ..... 451/420
5,390,431 A 2/1995 Friel
5,527,208 A * 6/1996 Blake et al. ..... 451/367
5,545,081 A 8/1996 Haffely et al.
5,582,535 A 12/1996 Friel
5,582,542 A * 12/1996 Stein ..... 451/367
5,618,226 A * 4/1997 Ueyama ..... 451/234
5,727,991 A 3/1998 Main
5,897,428 A * 4/1999 Sakcriska ..... 451/202
5,938,511 A * 8/1999 Patterson ..... 451/377
5,944,592 A 8/1999 Hall et al.

* cited by examiner

*Primary Examiner*—George Nguyen
(74) *Attorney, Agent, or Firm*—Watts, Hoffmann, Fisher & Heinke Co.

(57) ABSTRACT

A sharpening attachment for sharpening cutting implements with a rotating bit of a tool. The sharpening attachment includes a guide, a mount and a clamp. The guide is adapted for attachment to a rotary tool. The mount is connected to the guide, such that the mount is laterally movable along the guide. The clamp clamps the cutting implement to the mount. Movement of the mount along the guide brings the cutting implement into contact with the rotating bit.

16 Claims, 7 Drawing Sheets

SHARPENER ATTACHMENT FOR ROTARY TOOL

CROSS-REFERENCE TO RELATED APPLICATION

The present application is a continuation-in-part of U.S. patent application entitled "Sharpener Attachment for Rotary Tool" Ser. No. 09/713,715, filed Nov. 15, 2000 now abandoned.

TECHNICAL FIELD

The present invention relates to tool sharpening apparatuses, and more particularly, is directed to a sharpener attachment for a router or similar rotary tool.

BACKGROUND ART

A number of cutting tools include cutting edges that must be kept free from surface infections, such as burrs, nicks and gouges. Such cutting tools which need to be free from surface imperfections include chisels, planar blades, scrapers, knife members of planar machines and knife members ofjoiner machines. When surface imperfections are present on the cutting edge of tools used to remove wood from a work piece, the surface imperfection can gouge the wood surface, requiring additional sanding to be performed to obtain an acceptable appearance of the work piece.

It is known in the prior art to remove burrs and nicks and to sharpen a cutting edge of a cutting tool with a stone surface, such as wet stone, oil stone or bench stone. Such stones may be composed of natural stone or artificial material, such as silicon carbide or aluminum oxide and are available in a variety of grits. By repeated movement of the cutting edge of the cutting tool on the stone at the proper angle, material is abraded from the cutting edge surface. Typically, a stone having a course or medium grit size is used to remove surface imperfections from the cutting edge or to straighten the cutting edge. A stone having a relatively fine grit is typically employed to complete sharpening of the cutting edge.

The correct angle should be maintained between the tool and the abrading surface so that the edge is evenly sharpened. Typically, cutting tools, such as planes and chisel blades are manufactured with a cutting edge bevel that is formed by a 2 to 1 slope or an angle of approximately 25°. Maintaining a constant angle of the tool being sharpened with respect to the sharpening surface is very difficult, because the tool must be stroked across the stone surface while maintaining substantially constant pressure between the edge and the stone. Manual sharpening of a cutting tool by repeated stroking over an abrasive stone or other abrasive surface is very time consuming.

U.S. Pat. No. 5,944,592 to Hall et al. discloses a sharpening apparatus that includes a support block that holds a chisel at a desired angle. A pusher member is connected to the support block for applying a constant force to the chisel to urge the chisel's tip against the abrasive surface. Manual or powered reciprocating movement of the support block affects abrasive action of the work piece tip against the abrasive surface to form the desired geometry.

U.S. Pat. No. 5,545,081 to Haffley et al. discloses an apparatus for holding a tool having a cutting edge in a predetermined abrading orientation with respect to a tool abrading apparatus. The apparatus includes an adjustment assembly that selectively advances and retracts a positioning member to position the tool into a predetermined abrading orientation. A tool retaining member selectively retains the tool in the predetermined abrading orientation.

DISCLOSURE OF INVENTION

The present invention concerns a sharpening attachment for sharpening cutting implements with a rotating bit of a rotary tool. The sharpening attachment includes a guide, a mount, and a clamp. The guide is configured to be connected to the rotary tool. The mount is connected to the guide such that the mount is laterally moveable along the guide. The clamp fastens the cutting implement to the mount in a position such that movement of the mount along the guide brings the cutting implement into contact with the rotating bit.

In one embodiment, the rotary tool is a router. In this embodiment, the sharpening attachment may include a mounting plate that facilitates attachment of the guide to the router or the guide may be adapted to be attached to a router table to which the router is attached.

In one embodiment, the guide includes a first end that is adapted for rotative connection to the sharpening tool and a second end that is adapted to be fixedly connected to the sharpening tool. In this embodiment, the second end of the guide may include a fine adjustment mechanism.

In one embodiment, the guide is a rail having a first end that is attached to a first mounting block and a second end that is attached to a second mounting block. The mounting blocks may be attached to the rotary tool. In one embodiment, the sharpening attachment includes a guard that is mountable to the sharpening tool to prevent the rotating bit of the rotary tool from causing injury.

A cutting implement is sharpened with a rotating bit of a rotary tool by clamping the cutting implement to a mount that is laterally movable along a guide. The guide is then positioned such that lateral movement of the mount along the guide brings the cutting edge of the cutting implement into contact with the rotating bit. The mount and the cutting implement are laterally moved along the guide to sharpen the cutting implement with the rotating bit.

In one embodiment the guide is connected directly to the rotary tool. The step of positioning the guide may be accomplished by rotating the guide about a first guide end which is rotatively connected to the sharpening tool and then fixing the second guide end to the sharpening tool. In one embodiment, the step of clamping the cutting implement to the mount holds the cutting implement at a desired angle with respect to the rotating bit.

The design of the present invention provides a cost-effective way to very quickly sharpen cutting implements and produce an extremely high quality cutting edge. The design of the present invention produces a cutting edge having a bevel of the desired angle, while squaring up blade edges. In addition, the sharpening attachment may be used with rotary tools that are typically available at construction sites, cabinet shops, furniture shops, home work shops and boat building sites, eliminating the need to provide a separate sharpening apparatus for sharpening cutting tools that are used at the construction site. The sharpener attachment quickly sharpens chisels and plane blades, and eliminates the need for time consuming hand sharpening. The attachment can be attached to a rotary tool in a short period of time. The limited number of parts associated with the attachment makes the sharpener very economical to produce and makes assembly and disassembly very easy. The attachment is lightweight and portable and provides both coarse and fine sharpening.

Additional features of the invention will become apparent and a fuller understanding will be obtained by reading the following detailed description in connection with the accompanying drawings.

BRIEF DESCRIPTION OF DRAWINGS

4

BEST MODE FOR CARRYING OUT THE INVENTION

Figure 1:
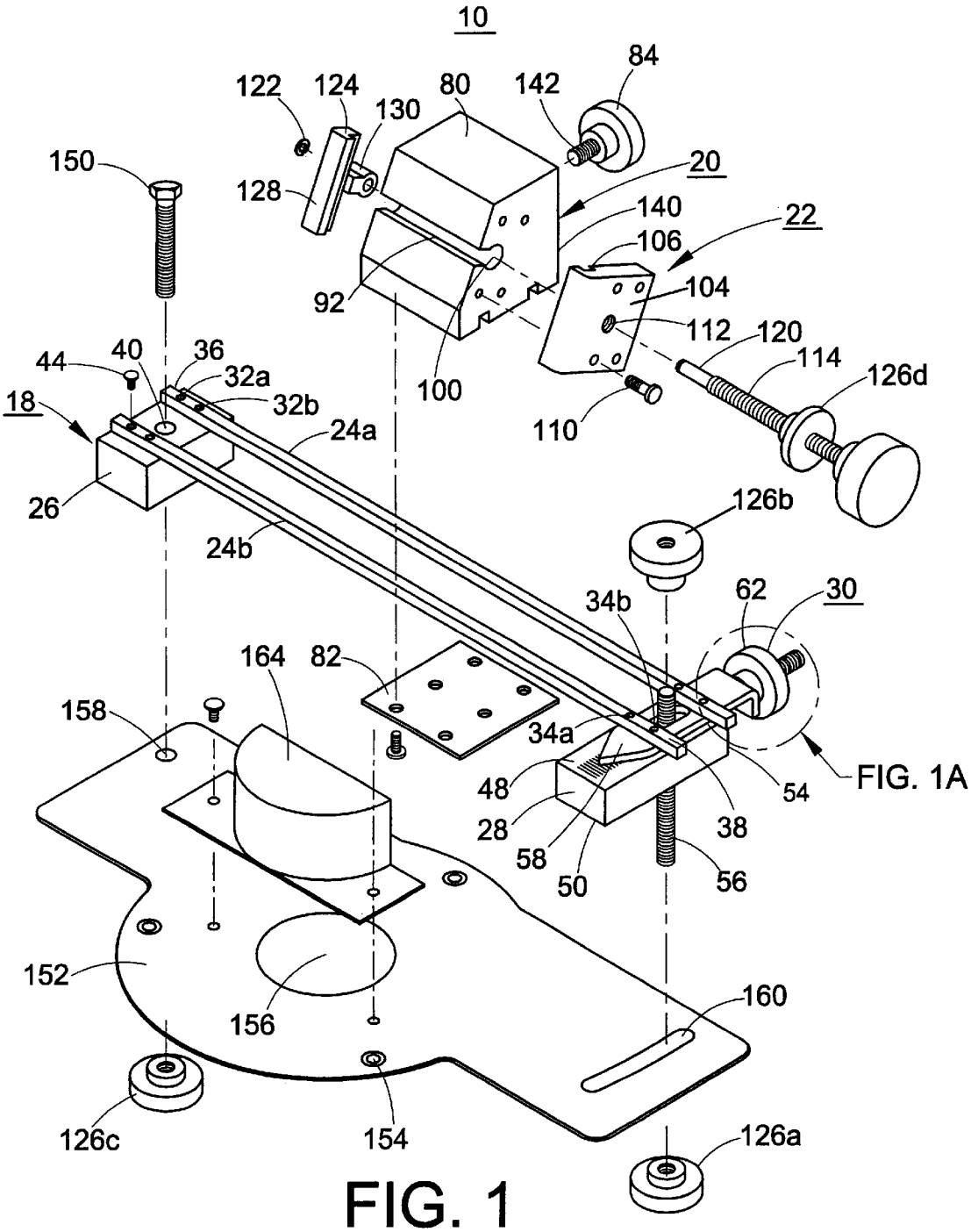
FIG. 1 is an exploded perspective view of a sharpening attachment, for sharpening cutting implements and a mounting plate.
Figure 2:
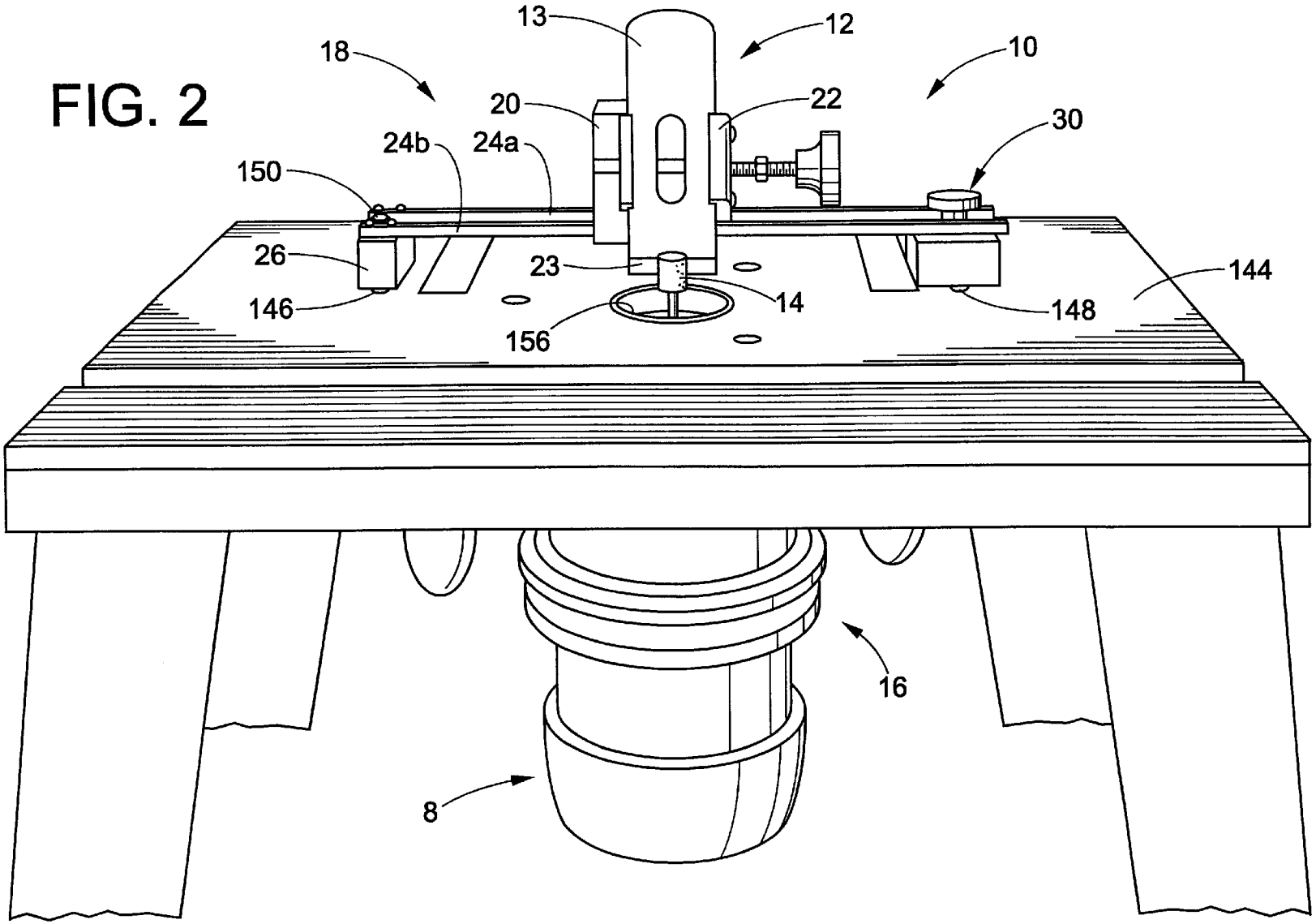
FIG. 2 is a perspective view of a sharpening attachment, for sharpening cutting implements, mounted to a router table.
Figure 3:
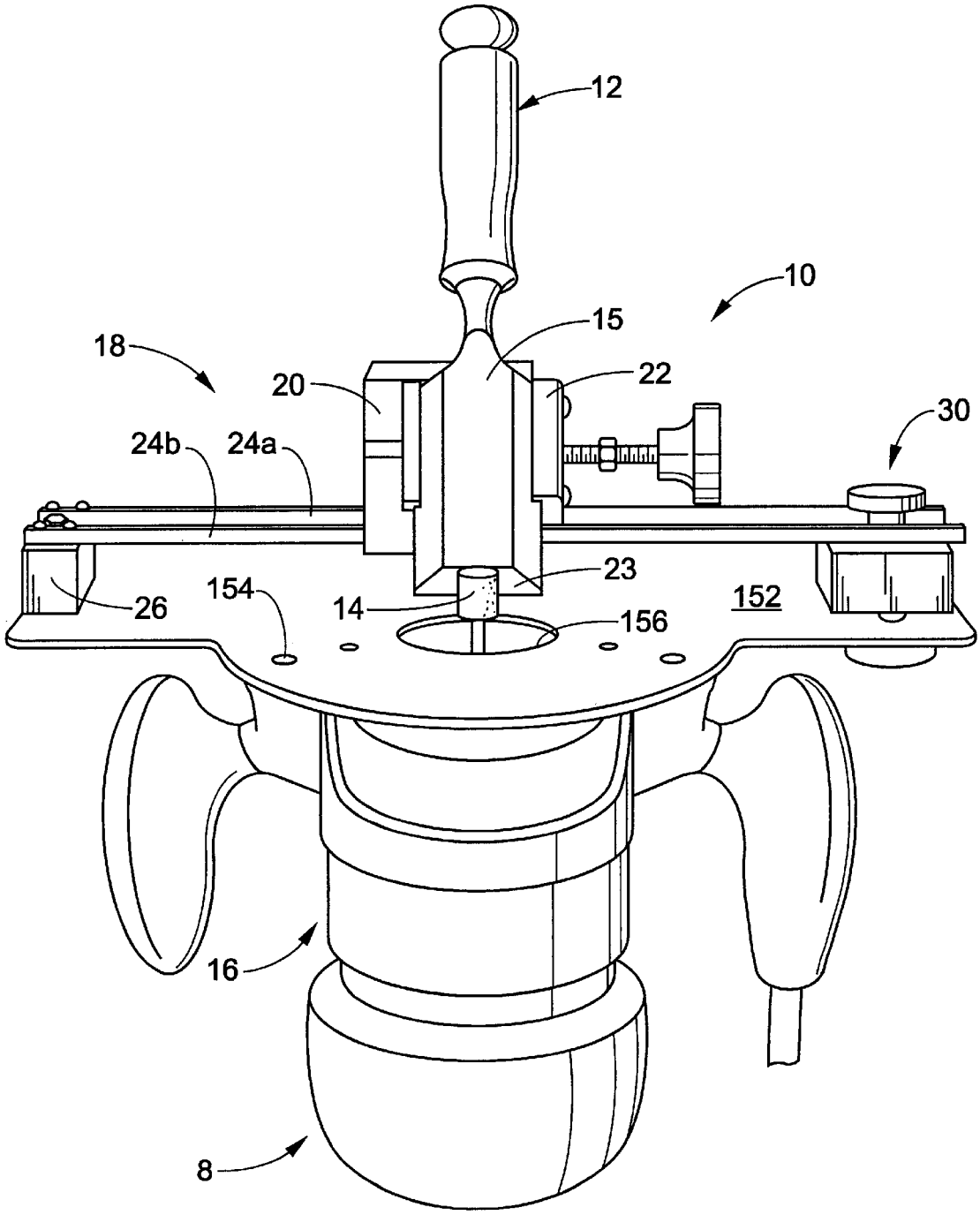
FIG. 3 is a perspective view of a sharpening attachment, for sharpening cutting implements, mounted to a router by a mounting plate.

Referring to FIGS. 1, 2 and 3, the present invention is directed to a sharpening attachment 10 for sharpening cutting implements 12, such as plane blades 13 (FIG. 2) and chisels 15 (FIG. 3) with a rotating bit 14 of a sharpening tool 16, such as a router 8. The sharpening attachment 10 includes a guide 18, a mount 20 and a clamp 22. The guide 18 is adapted to be connected to the sharpening tool 16. The mount 20 is connected to the guide 18 such that the mount 20 is laterally movable along the guide. The clamp 22 is connected to the guide 18. The clamp allows cutting implements 12 to be clamped to the mount 20, such that movement of the mount 20 along the guide 18 brings the cutting implements 12 into contact with the rotating bit 14 at an appropriate angle, sharpening a cutting edge 23 with the rotating bit.

Referring to FIG. 1, the guide 18 includes first and second rails 24*a*, 24*b*, a stationary end block 26, and a fine adjustment mechanism 30 that includes a pivot adjusting block 28. Each rail 24*a*, 24*b* includes two clearance holes 32*a*, 32*b* at a first end 36 and two threaded holes 34*a*, 34*b* at a second end 38. The stationary end block 26 includes a large clearance hole 40 and four threaded holes (not shown, hidden by the rails). In the exemplary embodiment, the first end 36 of each rail 24*a*, 24*b* is connected to the stationary end block 26 by rail mounting screws 44 that pass through the clearance holes 32*a*, 32*b* in the rails and threadedly engage the threaded holes (not shown) in the stationary end block 26.

Figure 6A:
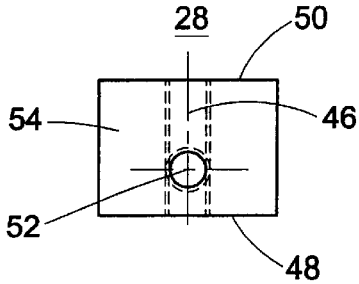
FIG. 6A is a rear elevational view of a pivot adjusting block.
Figure 6B:
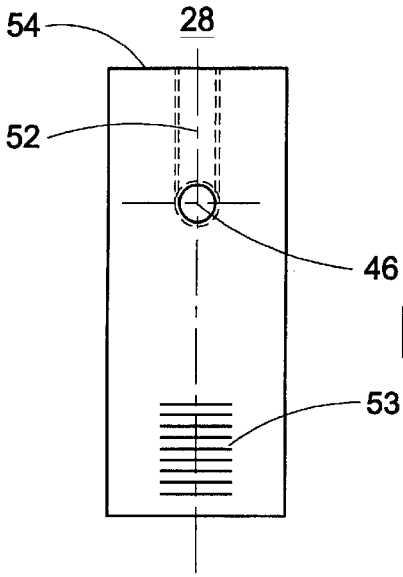
FIG. 6B is a top plan view of a pivot adjusting block.

Referring to FIGS. 6A and 6B, the pivot adjusting block 28 includes a threaded hole 46 that extends through top and bottom surfaces 48, 50 of pivot adjusting block 28. The pivot adjusting block 28 also includes a blind threaded hole 52 that extends into the block from a rear surface 54. Referring to FIG. 1, a threaded course adjusting stud 56 is threaded through the threaded hole 46 of the pivot adjusting block 28, such that a portion of the course adjusting stud 56 extends through each of the top and bottom surfaces 48, 50 of the pivot block 28.

Figure 1A:
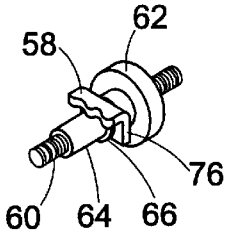
FIG. 1A is a partial view of a fine adjustment mechanism.
Figure 5A:
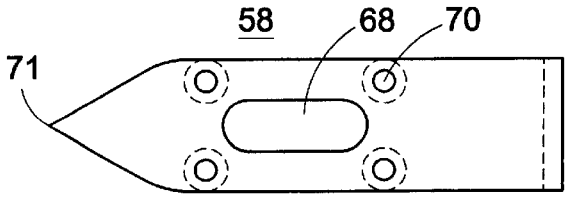
FIG. 5A is a top plan view of a fine adjustment plate.
Figure 5B:
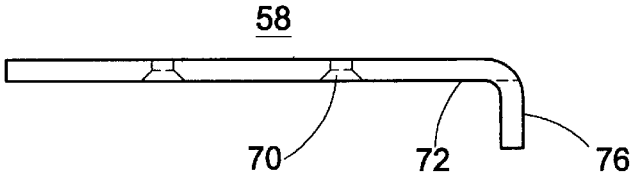
FIG. 5B is a front elevational view of a fine adjustment plate.
Figure 5C:
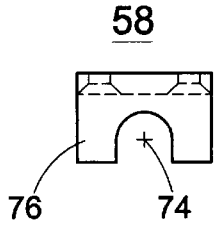
FIG. 5C is a side elevational view of a fine adjustment plate.

Referring to FIGS. 1 and 1A, in addition to the pivot adjusting block 28, the fine adjustment mechanism 30 includes a fine adjustment plate 58, a fine adjustment stud 60, a fine adjustment knob 62, a spring 64, and a washer 66. Referring to FIGS. 5A and 5B, the fine adjustment plate 58 includes a clearance slot 68, four countersink holes 70 in a lower side 72 and a cutout 74 in a rear flange 76.

Referring again to FIG. 1, the second end 38 of each rail 24*a*, 24*b* is attached to the fine adjustment plate 58 by flat head screws that extend through the countersunk holes 70 in the lower side 72 of the adjustment plate 58 and engage the threaded holes 34*a*, 34*b* in the second end 38 of each rail 24*a*, 24*b*. The clearance slot 68 in the adjustment plate 58 is disposed around the portion of the course adjusting stud 56 that extends through the top surface 48 of the pivot block 28. The bottom surface 72 of the adjustment plate 58 rests on the pivot adjusting block 28.

In the exemplary embodiment, the fine adjustment stud 60 is threaded into the blind threaded hole 52 in the rear surface 54 of the pivot block 28. The fine adjustment stud 60 extends from the blind threaded hole 52 through the cutout 74 in the fine adjustment plate 58. The spring 64 and washer 66 are disposed around the fine adjustment stud 60, as illustrated in FIG. 1A. The spring 64 and washer 66 are captured between the rear surface 54 of the pivot block 28 and the rear flange 76 of the fine adjustment plate 58. In the exemplary embodiment, the tension spring 64 is in contact with the rear surface 54 of the pivot block 28, and the washer 66 is pressed against the rear flange 76 by the tension spring 64.

The fine adjustment knob 62 is threaded onto the fine adjustment stud 60 and into contact with the rear flange 76 of the fine adjustment plate 58. The stationary end block 26 and the pivot adjusting block 28 are fixed when the first pivot adjusting locking knob 126*a* is tightened. When the second pivot adjusting locking knob 126*b* is loosened slightly, rotation of the fine adjustment knob 62 in one direction with respect to the fine adjustment stud pushes the fine adjustment plate 58 and the second ends 38 of the first and second rails 24*a*, 24*b* to move toward a front surface 78 of the pivot block 28 against the force of the spring. This movement of the rails moves the path of the cutting implement toward the rotating bit. Rotation of the fine adjusting knob 62 in a second direction with respect to the fine adjustment stud moves the fine adjustment knob away from the pivot adjustment block. The force supplied by the spring 64 causes the fine adjustment plate 58 and second ends of each of the rails 24*a*, 24*b* to move toward the rear surface 54 of the pivot block 28. A point 71 on the adjustment plate and score lines 53 provide the user of the sharpener attachment with an indication of the location of the cutting implement with respect to the rotating bit 14.

Figure 4B:
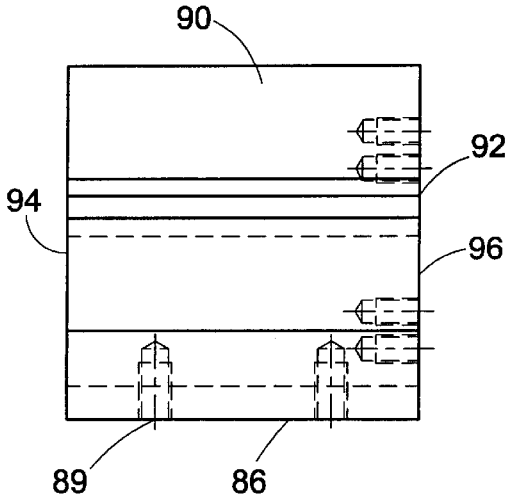
FIG. 4B is a front elevational view of a vice block.
Figure 4A:
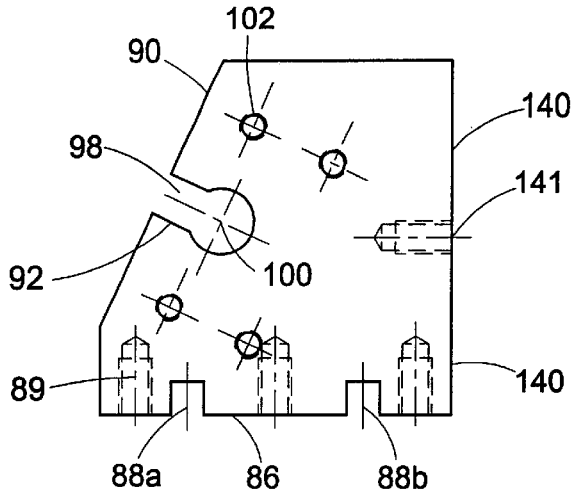
FIG. 4A is a side elevational view of a vice block.
Figure 4C:
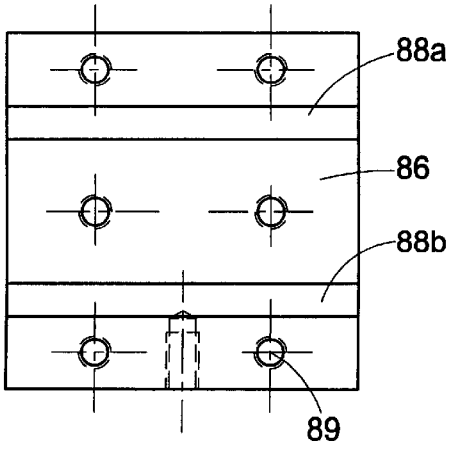
FIG. 4C is a bottom elevational view of a vice block.

In the exemplary embodiment, the mount 20 includes a sliding vice block 80, a vice block bottom plate 82 and a handle 84. Referring to FIGS. 4A, 4B and 4C, the exemplary sliding vice block 80 includes a lower surface 86 which includes two rectangular rabbets 88*a*, 88*b* that are sized and spaced apart to fit over the first and second rails 24*a*, 24*b* of the guide 18. The lower surface 86 of the block 80 also includes six blind threaded holes 89. The block bottom plate 82 includes six clearance holes that correspond to the threaded holes 89 in the block 80. The bottom plate 82 is fastened to the bottom of the block 82 to secure the block 80 to the rails 24*a*, 24*b*, but allowing the block 80 to slide along the rails.

Figure 4D:
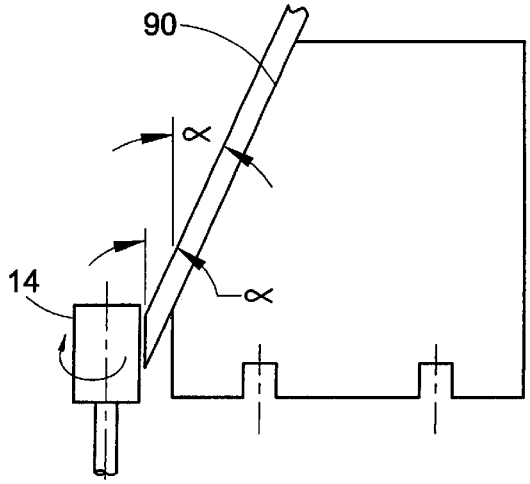
FIG. 4D is a side elevational view of a cutting tool maintained at an appropriate angle with respect to a rotating bit by a vice block.
Figure 10:
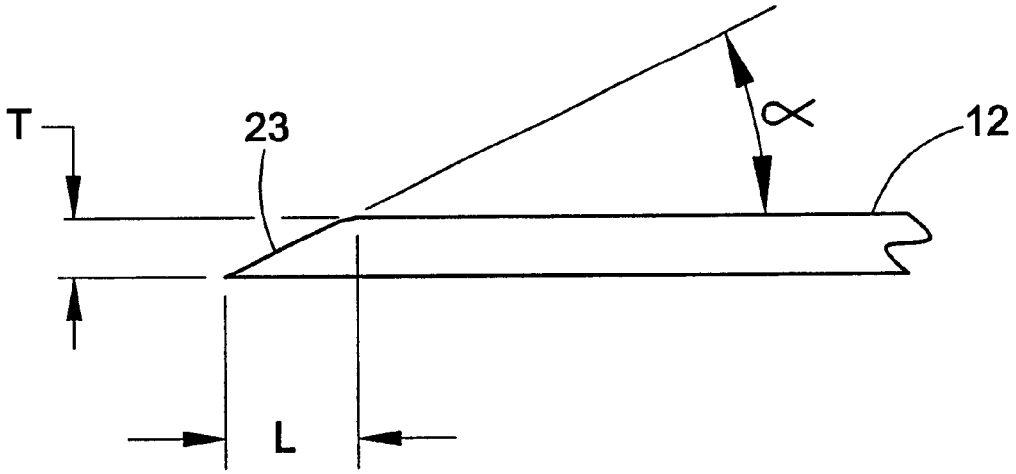
FIG. 10 is a side elevational view of a cutting tool.

A front surface 90 of the sliding block 80 is machined to clamp the cutting implement 12 at a desired angle to produce a cutting edge 23 having the desired angle. In the exemplary embodiment, the tool is sharpened to maintain approximately the same angle of the cutting edge 23 that the tool was initially constructed with. Referring to FIGS. 4D and 10, the slope of the bevel or cutting edge 23 of the cutting tool 12 is defined by the length "L" of the bevel or cutting edge 23 over the thickness "T" of the cutting tool 12. Typically, the ratio of the length "L" of the cutting edge 23 over the thickness "T" of the tool is 2 to 1 for plane blades and chisels, forming a tip angle of approximately 25°. Referring to FIG. 4D, since the side surface of the rotating bit is verticle, the desired cutting edge angle $\alpha$ front surface 90 of the block 80 $\alpha°$ from verticle. In the exemplary embodiment, the front surface 90 is approximately 25° from verticle to maintain approximately the original bevel of the tool 12.

Referring to FIGS. 4A–4C, the front surface 90 includes a vice slot 92 that extends from a first side 94 to a second side 96 of the vice block 80. The cross-section of the vice slot 92 is defined by a rectangular portion 98 that extends inward from the front surface 90 and a larger round portion 100 that extends further inward from the rectangular portion 98. In the exemplary embodiment, the second side 96 of the vice block 80 includes four threaded holes 102.

Referring to FIGS. 1 and 4A, rear surface 140 of the sliding vice block 80 includes a threaded hole 141. The handle 84 includes a threaded portion 142 that is threaded into the threaded hole 141 in the sliding vice block 80. The handle 84 is used to slide the sliding vice block 80 along the first and second rails 24*a*, 24*b*, that define the guide 18.

Figure 7A:
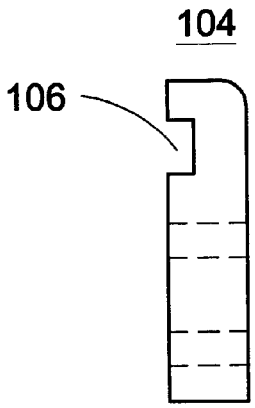
FIG. 7A is a side elevational view of a vice side plate.
Figure 7B:
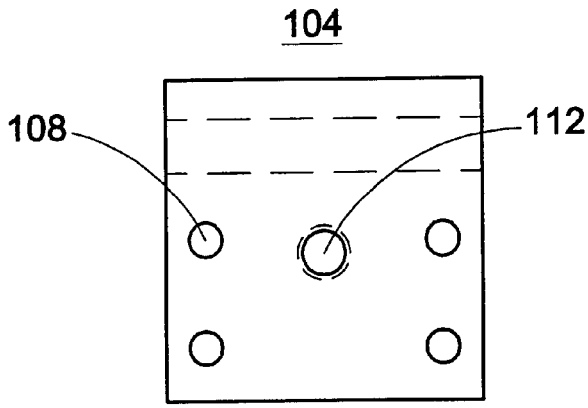
FIG. 7B is a front elevational view of a vice side plate.

In the exemplary embodiment, the clamp 22 includes a vice side plate 104, a vice clamping screw 114, a snap ring 122 and a vice clamping jaw 124. Referring to FIGS. 7A and 7B, the vice side plate 104 is a rectangular block having a channel 106 machined in one side of it. The vice side plate 104 includes four clearance holes 108 that are aligned with the threaded holes 102 of the vice block (see FIG. 1). The vice side plate 104 is connected to the sliding vice block 80 by four mounting screws 110 that are inserted through the clearance holes 108 in the vice side plate and are threaded into the threaded holes 102 in the vice block. Referring to FIG. 1, the channel 106 is aligned with the front surface 90 of the vice block. The vice side plate 104 includes a large threaded hole 112 that is aligned with the round portion 100 of the vice slot 92.

Figure 8:
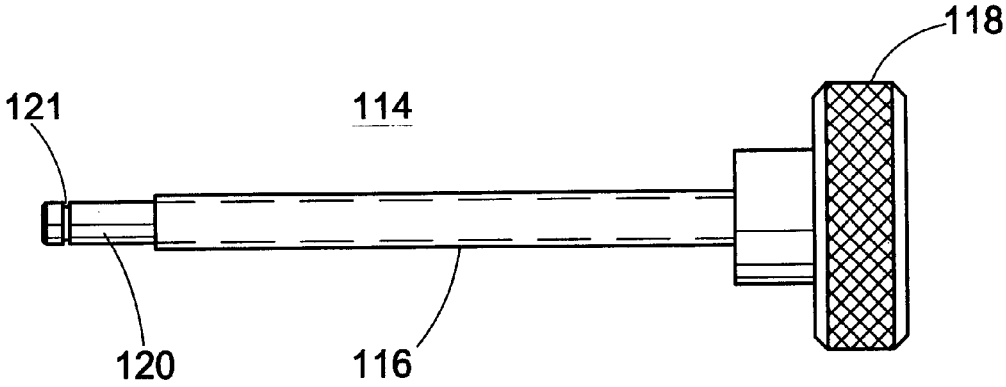
FIG. 8 is a front elevational view of a vice clamping screw.

Referring to FIGS. 1 and 8, the vice clamping screw 114 is threaded through the threaded hole 112 of the vice side plate 104. The vice clamping screw 114 includes a threaded portion 116, a knob 118 and a machined end 120 having a notch 12 that accepts a snap ring 122 that holds the vice clamping jaw 124 on the machined end 120 of the vice clamping screw 114. The threaded portion 116 of the vice clamping screw 114 is threaded into the threaded hole 112 of the vice side plate 104. In the exemplary embodiment, a locking knob 126*d* is threaded on the threaded portion 116 of the vice clamping screw 114 between the vice side plate 104 and the knob 118. Tight engagement between the locking knob 126d and the side plate 104 locks the clamping screw 114 in place.

Figure 9A:
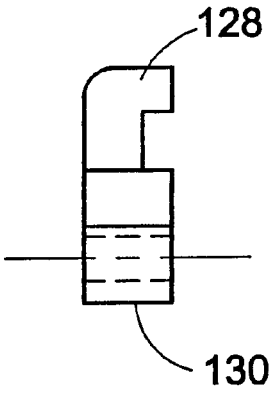
FIG. 9A is a front elevational view of a vice clamping jaw.
Figure 9B:
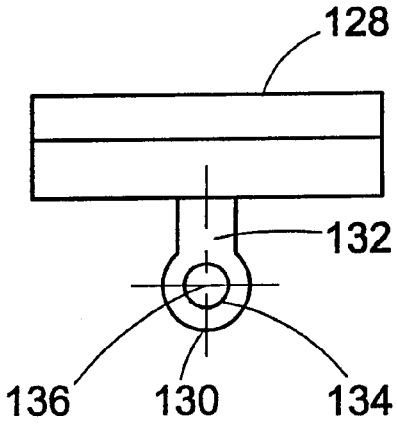
FIG. 9B is a side elevational view of a vice clamping jaw.

Referring to FIGS. 1, 9A and 9B, the round portion 100 of the clamping jaw 124 includes a hole 136 that fits over the machined end 120 of the clamping screw 114. The vice clamping jaw 124 is secured to the machined end 120 of the vice clamping screw 114 by the snap ring 122. The vice clamping jaw 124 includes an elongated clamping portion 128 and a keyed portion 130. The keyed portion 130 includes a rectangular portion 132 and a round portion 134 that are slightly smaller than the rectangular portion 98 and round portion 100 of the vice slot 92. Since the keyed portion 130 is slightly smaller than the slot 92, the keyed portion 130 is able to slide within the vice slot 92. Rotation of the vice clamping screw 114 causes the vice clamping jaw 124 to move along the path defined by the channel 106 in the sliding vice block 80. Referring to FIG. 9A, the clamping portion 128 is L-shaped such that the front surface 90 of the vice block and the clamping portion define a channel, that is aligned with the channel 106 in the vice side plate 104. Rotation of the clamping screw 114 clamps a cutting tool 12 to the sliding vice block 80. The adjustability of the clamp 22 allows a wide variety of cutting implements 12 to be sharpened by the sharpening attachment 10 of the present invention.

Referring to FIGS. 2 and 3, the sharpening attachment 10 is used with a router 8 in the exemplary embodiment. In a first embodiment, shown in FIG. 2, a router table 144 is modified such that the sharpening attachment 10 may be mounted to the router table 144. In this embodiment, a hole 146 and an arcuate slot 148 are cut in the router table 144 for attachment of the sharpening attachment 10. The radius of the arc that defines the arcuate slot 148 is equal to the distance between the large clearance hole 40 in the stationary end block 26 and the threaded hole 46 in the pivot block 28. In the exemplary embodiment, the stationary end block 26 is connected to the router table 144 by a hex head cap screw 150 that extends through the stationary end block 26 and the hole 146 in the router table 144. A locking knob 126c is secured to the screw 150 to secure the connection. The connection between the stationary end block 26 and the router table 144 is such that the stationary block is permitted to rotate.

The lower portion of the coarse adjusting stud 56 that extends from the bottom surface 50 of the pivot adjusting block 28 and extends through the slot 148 in the router table 144 (not shown in FIG. 2). The coarse adjusting stud 46 and pivot adjusting block 28 are moved in the slot 148 in the router table 144 to an approximate sharpening position and are locked in place by a locking knob 126*a* (not shown in FIG. 2) that is disposed below the router table 144. Fine adjustment of the guide 18 is accomplished by turning the fine adjustment knob 62 to move the rails toward and away from the bit 14 of the router 8.

Referring to FIG. 3, in a second embodiment, the sharpening attachment 10 includes a mounting plate 152 that allows the sharpening attachment 10 to be connected directly to the router 8. Referring to FIG. 1, the router mounting plate 152 is a large flat plate which includes three countersunk holes 154 that allow for attachment to a router 8 and a center hole 156 that allows the rotating bit 14 of the router 8 to extend through the mounting plate 152. The mounting plate 152 includes a hole 158 and an arcuate slot 160. The sharpening attachment 10 is mounted to the mounting plate 152 in generally the same manner it is mounted to a router table 144 having a hole 146 and an arcuate slot 148. The hex head cap screw 150 is inserted through the hole 158, the coarse adjusting stud 56 is inserted through the slot 160 and the cap screw 150 and the stud 56 are fastened to the mounting plate 152 with locking knobs 126.

In the exemplary embodiment, the bit 14 is coupled to the router 8. The sharpening bit 14 may be made from stone, ceramic or any other suitable material that is effective for sharpening blades. Sharpening bits that may be used with the present invention are readily available at hardware stores. Each of the parts of the sharpening attachment 10 may be made from readily available materials, such as steel, aluminum, plastic, wood or any other suitable material.

In the exemplary embodiment, the sharpening attachment 10 includes a guard 164 that covers the bit 14. If the bit 14 breaks, or causes debris to fly from the cutting implement, the guard will reduce the possibility of debris reaching the user of the sharpening attachment 10.

The sharpening attachment 10 of the present invention allows a variety of cutting implements 12 to be sharpened with a rotating bit 14 of a router 8 or other rotary tool such as a drill or dremmel tool. The stationary end block 26 is rotatively fastened to the router 8 or other rotary tool. In the exemplary embodiment, the cutting implement 12 is placed on the front surface 90 of the vice block 80 and is clamped at the desired angle to the vice block 80 by rotating the vice clamping screw 114. The pivot adjusting block 28 is moved along a slot 148, 160 in the router table 144 or mounting plate 152 causing the guide rails to rotate about their first ends 36, 38. Once in roughly the desired position, the pivot adjusting block 28 is fixed by a locking knob 126*a*, fixing the pivot adjusting block 28. The locking knob 126*b* is slightly loosened. The fine adjustment knob 62 is rotated, causing movement of the fine adjustment plate and rotation of the second ends of the rails 24*a*, 24*b* about their first ends, bringing the rails into a more precise sharpening position. The locking knob 126*b* is then tightened to secure the rails 24*a*, 24*b* and adjustment plate to the pivot adjusting block. When in the desired sharpening position, lateral movement of the mount 20 brings the cutting edge 23 of the cutting implement 12 into contact with the rotating bit 14 at the desired angle $\alpha$. The mount 20 and the cutting implement 12 fixed to the mount 20 are laterally moved along the rails 24*a*, 24*b* of the guide 18 past the rotating bit 14 to sharpen the cutting implement 12 with the rotating bit 14. In the exemplary embodiment, the cutting edge is moved past the rotating bit several times to sharpen the cutting implement 12. The position of the first and second rails 24*a*, 24*b* is adjusted between sharpening passes by loosening the locking knob 126*b* rotating the fine adjusting knob, and retightening the locking knob 126*b*. Typically, the rails 24*a*, 24*b* are moved slightly closer to the bit 14 between passes.

Although the present invention has been described with a degree of particularity, it is the intent that the invention include all modifications and alternations falling within the spirit and scope of the appended claims.

I claim:

1. A sharpening attachment for sharpening cutting implements with a rotating bit of a router, comprising;

a) a guide connected to said router from the group consisting of a router, a drill and a dremmel tool;

b) a mount connected to said guide such that said mount is laterally movable along said guide; and c) a clamp for clamping said cutting implement to said mount, such that movement of said mount along said guide brings said cutting implement into contact with said bit.

2. The sharpening attachment of claim 1 further comprising a mounting plate that facilitates attachment of said guide to said router.

3. The sharpening attachment of claim 1 further comprising a guard mountable to said rotary.

4. The sharpening attachment of claim 1 wherein said guide includes a first end that is adapted for rotative connection to said rotary tool and a second end adapted for selectively fixed connection to said rotary tool.

5. The sharpening attachment of claim 1 further comprising a router table that is adapted for attachment of said guide.

6. The sharpening attachment of claim 1 wherein said second end includes a fine adjustment mechanism.

7. The sharpening attachment of claim 1 wherein said first guide end is connected to a first mounting block and said second guide end is attached to a second mounting block.

8. The sharpening attachment of claim 1 further comprising a guard mountable to said sharpening tool.

9. A sharpening attachment for sharpening cutting implements with a rotating bit of a rotary tool, comprising;

a) a guide adapted for connection to said rotary tool;

b) a mount connected to said guide such that said mount is laterally movable along said guide;

c) a clamp for clamping said cutting implement to said mount, such that movement of said mount along said guide brings said cutting implement into contact with said bit; and d) a router table that is adapted for attachment of said guide and said rotary tool.

10. A sharpening attachment for sharpening cutting implements with a rotating bit of a rotary tool, comprising;

a) a guide adapted for connection to said rotary tool, said guide includes a first end that is adapted for rotative connection to said rotary tool and a second end adapted for selectively fixed connection to said rotary tool;

b) a mount connected to said guide such that said mount is laterally movable along said guide; and c) a clamp for clamping said cutting implement to said mount, such that movement of said mount along said guide brings said cutting implement into contact with said bit.

11. The sharpening attachment of claim 10 wherein said second end includes a fine adjustment mechanism.

12. The sharpening attachment of claim 10 wherein said guide comprises a rail having a first end connected to a first mounting block and a second end attached to a second mounting block.

13. A sharpening attachment for sharpening cutting implements with a rotating bit of a router, comprising;

a) a pivoting block adapted for rotative attachment to said router, b) a stationary block adapted for fixed attachment to said router;

c) a rail having a first end attached to said pivoting block and a second end attached to said stationary block;

d) a mount connected to said rail such that said mount is laterally movable along said rail;

e) a clamp for clamping said cutting implement to said mount, such that movement of said mount along said guide brings said cutting implement into contact with said bit; and f) a guard adapted for connection to said sharpening to cover said bit. cutting implement into contact with said bit.

14. The sharpening attachment of claim 13 further comprising a mounting plate that facilitates attachment of said guide to the router.

15. The sharpening attachment of claim 13 further comprising a router table adapted to mount said pivoting block and said stationary block.

16. The sharpening attachment of claim 13 wherein said stationary block includes a fine adjustment mechanism.

* * * * *